US007890016B2

(12) United States Patent
Ota

(10) Patent No.: US 7,890,016 B2
(45) Date of Patent: Feb. 15, 2011

(54) CHARGING APPARATUS, IMAGE FORMING UNIT THAT EMPLOYS THE CHARGING APPARATUS, AND IMAGE FORMING APPARATUS THAT EMPLOYS THE IMAGE FORMING UNIT

(75) Inventor: Atsushi Ota, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/183,194

(22) Filed: Jul. 31, 2008

(65) Prior Publication Data

US 2009/0052935 A1 Feb. 26, 2009

(30) Foreign Application Priority Data

Aug. 20, 2007 (JP) ..... 2007-213736

(51) Int. Cl.
*G03G 15/02* (2006.01)

(52) U.S. Cl. ..... 399/100; 399/174; 399/176; 399/123

(58) Field of Classification Search ..... 399/100, 399/115, 174, 168
See application file for complete search history.

(56) References Cited

U.S. PATENT DOCUMENTS 5,557,373 A * 9/1996 Miyashita et al. ..... 399/9
6,219,505 B1 * 4/2001 Sato et al. ..... 399/98
2007/0098435 A1 * 5/2007 Kitagawa et al. ..... 399/100

FOREIGN PATENT DOCUMENTS

JP 03-100676 A 4/1991

* cited by examiner

*Primary Examiner*—David M Gray
*Assistant Examiner*—Roy Yi
(74) *Attorney, Agent, or Firm*—Panitch Schwarze Belisario & Nadel LLP

(57) ABSTRACT

A charging apparatus includes a charging roller and a cleaning member. The charging roller charges a surface of an image bearing body. The cleaning member extends in a longitudinal direction parallel to the charging roller and that cleans the charging roller. The charging apparatus includes a bearing and a supporting member. The bearing supports a shaft of the charging roller. The cleaning member is mounted to the supporting member the cleaning member is held between the supporting member and the charging roller. The supporting member includes a surface to which the cleaning member is mounted, the surface being a curved surface configured to a circumferential surface of the charging roller. The supporting member includes a surface to which the cleaning member is mounted, the surface including a flat portion extending upstream with respect to rotation of the charging roller and a curved portion extending downstream.

13 Claims, 10 Drawing Sheets

CHARGING APPARATUS, IMAGE FORMING UNIT THAT EMPLOYS THE CHARGING APPARATUS, AND IMAGE FORMING APPARATUS THAT EMPLOYS THE IMAGE FORMING UNIT

BACKGROUND OF THE INVENTION

The present invention relates generally to an image forming apparatus such as a copying machine, a printer, and a facsimile machine, and more particularly to a charging apparatus in which a roller type charging member is in pressure contact with an image bearing body.

A conventional electrophotographic image forming apparatus employs an image bearing body or a photoconductive drum. A spring urges a contact type charging roller against the photoconductive drum with a predetermined pressing force. The charging roller rotates in contact with the photoconductive drum, thereby uniformly charging the circumferential surface of the photoconductive drum.

However, the charging roller in pressure contact with the photoconductive drum suffers from a problem in that residual toner, external additive, and paper particles may adhere to the surface of the charging roller. Adhesion of foreign matter to the surface of the charging roller causes poor charging on a part of or over the entire circumferential surface of the photoconductive drum, resulting in poor print quality.

A solution to the problem has been proposed in which a cleaning member abuts the charging roller to clean the charging roller. Japanese Patent Publication No. 03-100676 discloses one such solution. A cleaning member or cleaning sponge is mounted to an inner wall of an image forming unit, being sandwiched under pressure between a charging roller and the inner wall.

The prior art disclosed in Japanese Patent Publication No. 03-100676 suffers from a problem in that the cleaning sponge and charging roller may not be assembled with high positional accuracy and therefore causes variations in the pressure exerted by the cleaning sponge on the charging roller.

BRIEF SUMMARY OF THE INVENTION

An object of the invention is to provide a charging apparatus that incorporates a cleaning member.

Another object of the invention is to provide a charging apparatus of simple construction and an easy-to-assemble charging apparatus.

A charging apparatus includes a charging roller that charges a surface of an image bearing body, and a cleaning member that extends in a longitudinal direction parallel to the charging roller and that cleans the charging roller. The charging apparatus includes a bearing and a supporting member. The bearing supports a shaft of the charging roller. The cleaning member is mounted to the supporting member the cleaning member is held between the supporting member and the charging roller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Embodiments of the invention will be described with reference to the drawings.

First Embodiment

The invention will be described with respect to an image forming apparatus in the form of a printer. The dimension, material, and shape of elements and their positional relation are exemplary only and may be modified in a variety of ways provided that the present invention may be embodied.

Figure 1:
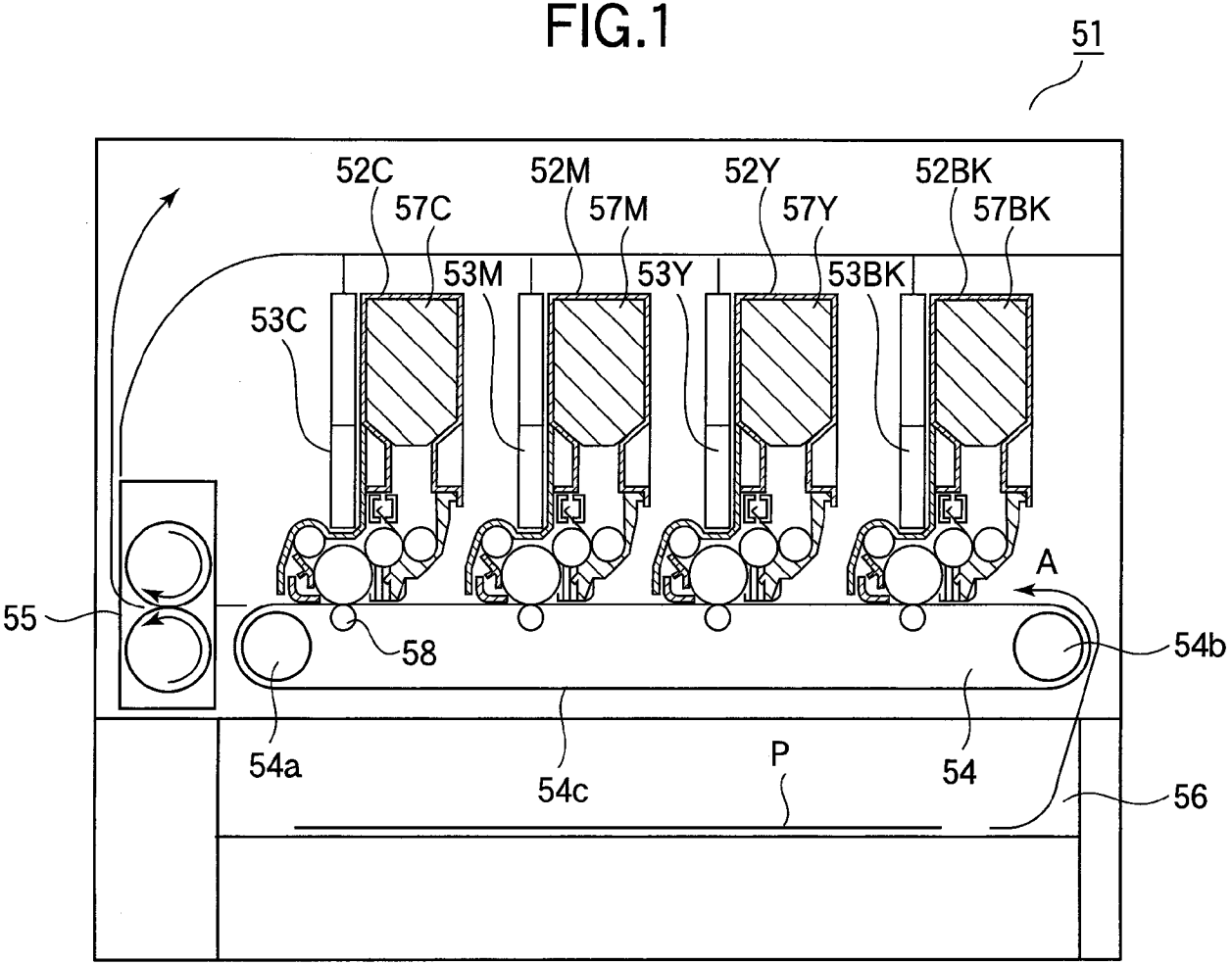
FIG. 1 illustrates a general configuration of a printer of a first embodiment.

FIG. 1 illustrates the general configuration of a printer of a first embodiment. Referring to FIG. 1, four image forming units 52BK (black), 52Y (yellow), 52M (magenta), and 52C (cyan) are detachably attached to a printer body 51. The printer body 51 also houses four LED heads 53BK (black), 53Y (yellow), 53M (magenta), and 53C (cyan) and further a transporting-and-transferring section or a transfer unit 54, a fixing section or a fixing unit 55, and a medium holding section or a paper cassette 56 that holds recording medium or paper P.

The image forming units 52BK, 52Y, 52M, and 52C include toner cartridges 54BK, 57Y, 57M, and 57C, respectively, which are detachably attached to the corresponding image forming units 52BK, 52Y, 52M, and 52C.

The image forming units 52BK, 52Y, 52M, and 52C are disposed in this order from upstream to downstream along a transport path, and form black (BK), yellow (Y), magenta (M), and cyan (C) toner images, respectively. The toner cartridge 57BK, 57Y, 57M, and 57C, hold black, yellow, magenta, and cyan toners, respectively, which are supplied to the image forming units 52BK, 52Y, 52M, and 52C, respectively.

The transfer unit 54 includes a first roller or a drive roller 54*a*, a second roller or an idle roller 54*b*, a belt 54C disposed about the drive roller 54*a* and idle roller 54*b*, and transfer rollers 58 disposed in correspondence to the respective image forming units 52BK, 52Y, 52M, and 52C.

The image forming units 52BK, 52Y, 52M, and 52C, transfer unit 54, fixing unit 55, paper cassette 56, toner cartridges 57BK, 57Y, 57M, and 57C are configured such that the toner cartridge is detachably attached to the printer, and may be replaced by a new, unused one when the toner therein is exhausted or the structural elements have deteriorated over time.

The image forming units 52BK, 52Y, 52M, and 52C will be described with reference to FIG. 2. Each of the image forming units 52BK, 52Y, 52M, and 52C may be substantially identical; for simplicity only the operation of the image forming unit 52BK for forming black images will be described, it being understood that the image forming units 52BK, 52Y, 52M, and 52C may work in a similar fashion.

Figure 2:
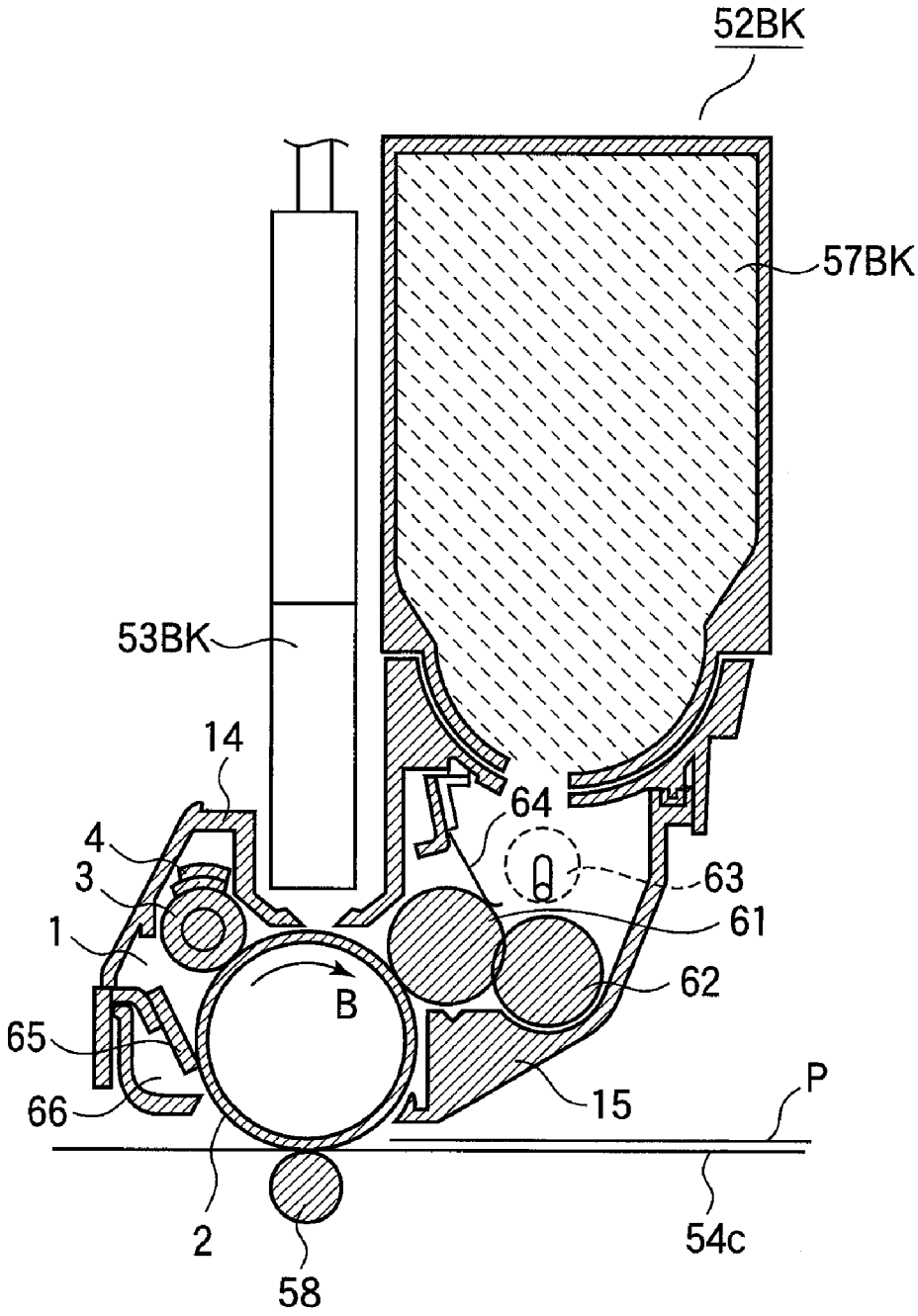
FIG. 2 illustrates a general configuration of an image forming unit.

FIG. 2 illustrates a general configuration of the image forming unit 52Bk. Referring to FIG. 2, the image forming unit 52BK includes an upper cover 14, a base cover 15, and a side case (not shown). The image forming unit 52BK includes an image bearing body or a photoconductive drum 2 having a photoconductive layer, a charging device 1 that charges the photoconductive drum 2, a developing roller 61 that supplies black toner to the photoconductive drum 2, and a sponge roller 62 that supplies the black toner to the developing roller 61.

The charging device 1 includes a charging roller 3 and a cleaning member 4. The charging roller 3 rotates in contact with the photoconductive drum 2 to uniformly charge the entire circumferential surface of the photoconductive drum 2. The cleaning member 4 cleans the charging roller 3.

A toner agitator 63 agitates the toner to supply the black toner to the sponge roller 62 at a predetermined rate. A developing blade 64 forms a thin layer of toner on the developing roller 61. A cleaning blade 65 scrapes off the residual toner from the photoconductive drum 2 after a toner image has been transferred onto the paper P. A waste toner reservoir 66 temporarily holds the residual toner (i.e., waste toner) scraped from the photoconductive drum 2.

The image forming process will be described. When the image forming unit 52BK initiates image formation, a drive source (not shown) drives the photoconductive drum 2 to rotate in a direction shown by arrow B, and a neutralizing lamp (not shown) irradiates the photoconductive drum with light, thereby neutralizing the surface of the photoconductive drum 2. After neutralization, the average surface potential of the photoconductive drum 2 is in the range of 0 to −150V.

The charging roller 3 is freely rotatable and is in contact with the photoconductive drum 2, so that when the photoconductive drum 2 rotates, the charging roller 3 rotates. A high voltage is applied to the charging roller 3 so that when the charging roller 3 rotates, the circumferential surface of the photoconductive drum 2 is charged uniformly to, for example, −1100 V approximately. Then, the LED head 53BK illuminates the charged surface of the photoconductive drum 2 in accordance with image information, thereby forming an electrostatic latent image having a potential in the range of 0 to −290 V.

The toner agitator 63 supplies the toner to the sponge roller 62 at the predetermined rate. Then, the sponge roller 62 supplies the toner to the developing roller 61. The developing blade 64 forms a thin uniform layer of toner on the developing roller 61.

The photoconductive drum 2 on which the electrostatic latent image is formed rotates in contact with the thin layer of toner formed on the developing roller 61, so that the toner on the developing roller 61 adheres to the electrostatic latent image to develop the electrostatic latent image into a toner image.

The toner image formed on the photoconductive drum 2 is transferred onto the paper P transported from the paper cassette 56 to the image forming section 52BK. Some of the toner on the photoconductive drum 2 may fail to be transferred onto the paper P and remains on the photoconductive drum 2. The cleaning blade 65 abuts the photoconductive drum 2 and scrapes the residual toner from the photoconductive drum 2. Thus, the residual toner falls into the waste toner reservoir 66. The waste toner in the waste toner reservoir 66 is then transported to a waste toner chamber (not shown) which in turn stores the waste toner therein.

The image forming process is also carried out in the remaining image forming units 52Y, 52M, and 52C, thereby forming black, yellow, magenta and cyan toner images as well as transferring these toner images onto the paper P.

In other words, referring to FIG. 1, the black, yellow, magenta, and cyan toner images are transferred by the transfer rollers onto the paper P one over the other in registration as the paper P is transported by the belt 54*c* in a direction shown by arrow A, thereby forming a full color toner image on the paper P. Then, the paper P passes through the fixing device 55 where the full color toner image is fused, and is then discharged by a discharging roller (not shown) to the outside of the apparatus.

Figure 3:
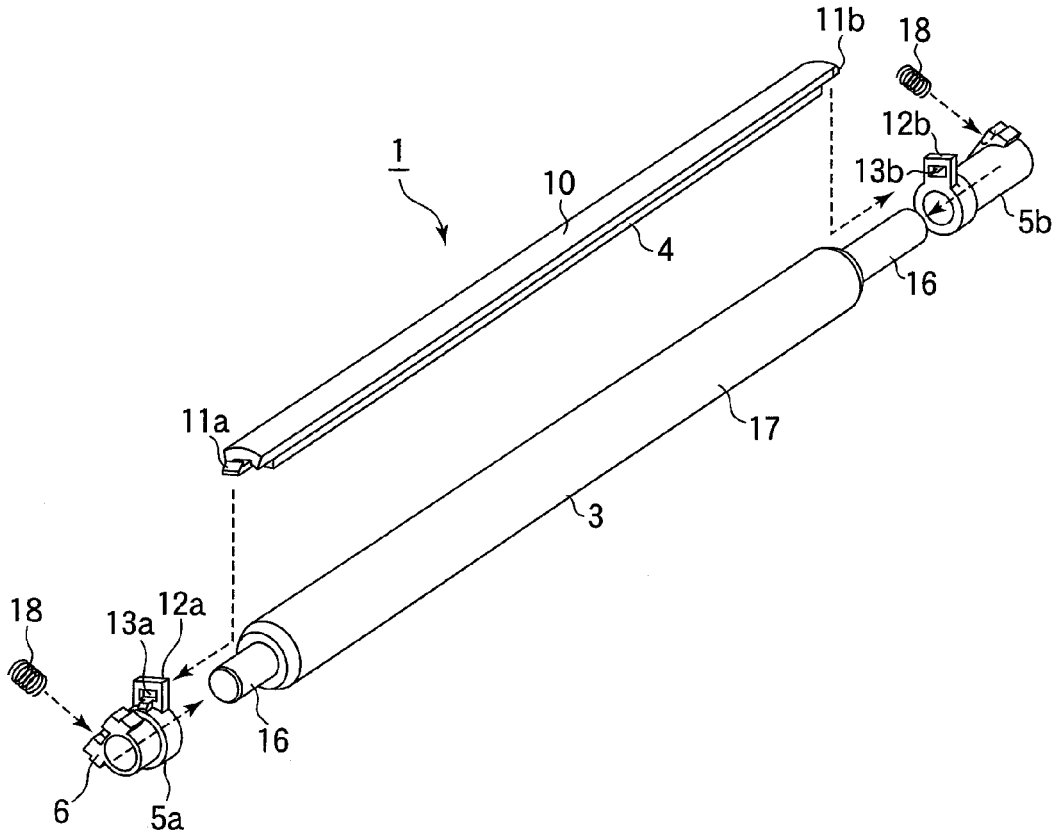
FIG. 3 is an exploded perspective view of a charging device of the first embodiment.

The charging device 1 will be described in detail. FIG. 3 is an exploded perspective view of the charging device 1 of the first embodiment. Referring to FIG. 3, the charging device 1 includes a charging roller 3 that uniformly charges the circumferential surface of the photoconductive drum 2, a cleaning member 4 that cleans the charging roller 3, a supporting member 10 that supports the cleaning member 4, and bearings 5*a* and 5*b* on which a shaft 16 of the charging roller 3 is supported.

The shaft 16 is, for example, a metal shaft, and is covered with an electrically conductive rubber 17 that exhibits little hygroscopicity and has stable resistance. A high voltage is applied to the shaft 16 with the surface of the conductive rubber 17 in contact with the surface of the photoconductive drum 2, thereby uniformly charging the surface of the photoconductive drum 2. Longitudinal end portions of the shaft 16 are rotatably supported by the bearings 5*a* and 5*b*.

The cleaning member 4 is formed of a sponge material, for example, urethane sponge, and is mounted to a surface of the supporting member 10 by means of a double stick tape. The supporting member 10 includes hooks 11*a* and 11*b* formed at its longitudinal ends, the hooks 11*a* and 11*b* engaging rectangular holes 13*a* and 13*b* of coupling portions 12*a* and 12*b* formed on the bearings 5*a* and 5*b*, respectively. The supporting member 10 is assembled together with the bearings 5*a* and 5*b* in an integral structure.

Figure 4:
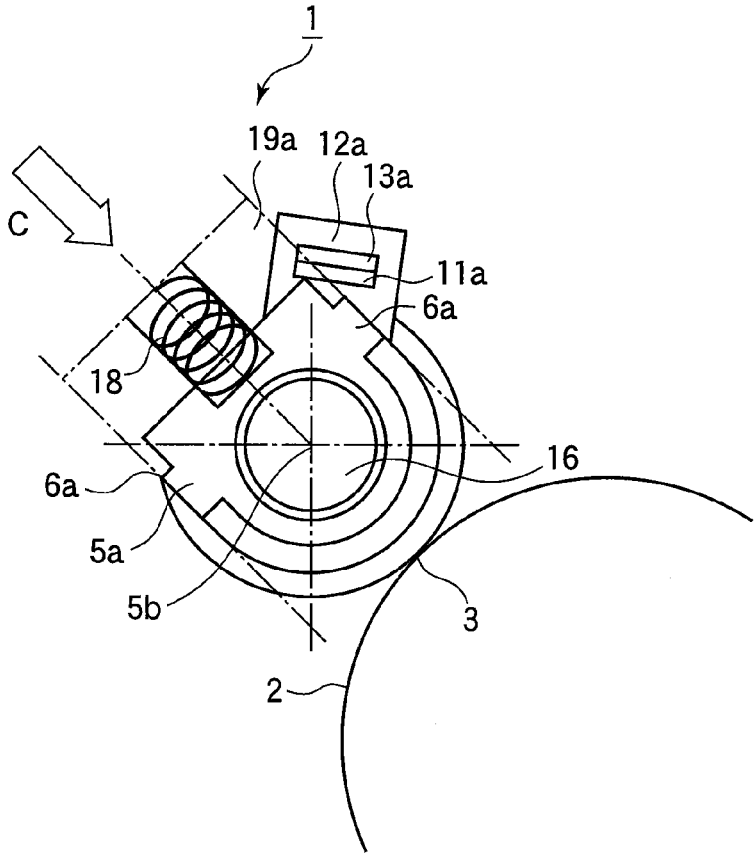
FIG. 4 is a side view of the charging device.

FIG. 4 is a side view of the charging device 1. Referring to FIG. 4, a spring 18 urges the bearing 5*a* toward the photoconductive drum 2 such that the charging roller 3 is in pressure contact with the photoconductive drum 2 under predetermined pressing force.

The bearing 5*a* includes engagement portions 6*a*. When the bearing 5*a* has been assembled into the printer, the engagement portions 6*a* are slidable on the walls of bearing guide 19*a* (FIG. 9) in a direction shown by arrow C until the charging roller 3 is urged by the spring 18 against the photoconductive drum 2.

A coupling portion 12*a* is formed in one piece with the bearing 5*a*, being angularly spaced from a projection 6 with respect to an axis 5*b*. The coupling portion 12*a* engages the supporting member 10 such that the supporting member 10 and the bearing 5*a* are assembled together in an integral assembly.

Figure 5:
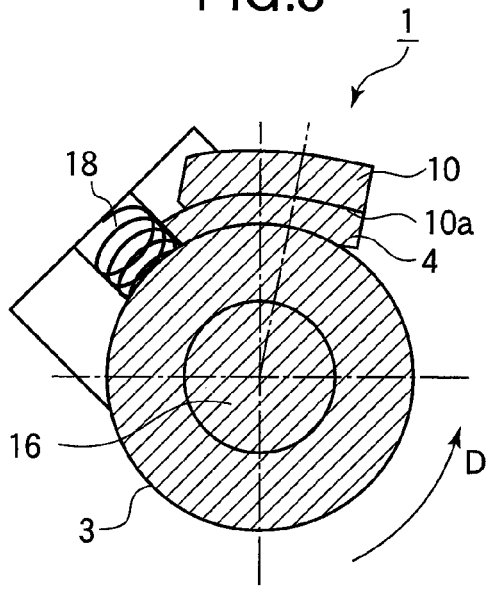
FIG. 5 is a cross-sectional view of the charging device.

FIG. 5 is a cross-sectional view of the charging device 1. Referring to FIG. 5, the cleaning member 4 is mounted to a surface 10*a* of the supporting member 10 closer to the charging roller 3 so that the cleaning member 4 is sandwiched between the supporting member 10 and the charging roller 3. The cleaning member 4 slides on the charging roller 3, applying an appropriate pressing force on the charging roller 3.

Figure 6:
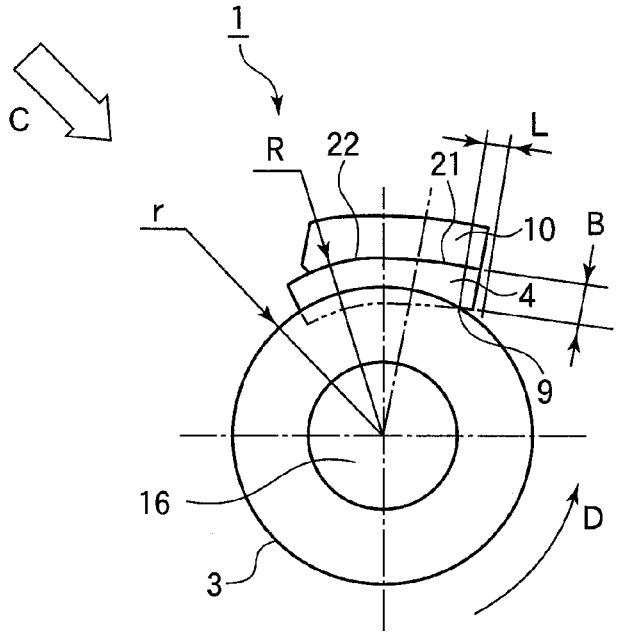
FIG. 6 illustrates a cleaning member when it is mounted to a charging roller.

FIG. 6 illustrates the cleaning member 4 when it is mounted to the charging roller 3. Referring to FIG. 6, the supporting member 10 has a flat surface 21 and a curved surface 22. The flat surface 21 extends upstream of the curved surface 22 with respect to rotation of the charging roller 3, being substantially parallel to a plane tangent to the charging roller 3. The curved surface 22 extends downstream of the flat surface 21 with respect to rotation of the charging roller 3, being in a plane substantially coaxial with the circumferential surface of the charging roller 30. The cleaning member 4 has a uniform thickness B before it is mounted to the charging roller 3. Once the cleaning member 4 has been mounted to the charging roller 3, the cleaning member 4 resiliently deforms so that the thickness of the cleaning member 4 upstream of a contact point 9 remains B. A portion of the cleaning member 4 downstream of the contact point 9 is pressed to resiliently deform so that the cleaning member 4 slides on the surface of the charging roller 3 in intimate contact with the charging roller 3, applying a stable pressing force to the charging roller 3.

When the charging roller 3 rotates, the cleaning member 4 upstream of the contact point 9 is not in contact with the charging roller 3. The cleaning member 4 contacts the charging roller 3 at the contact point 9 but the charging roller 3 does not apply pressure to the cleaning member 4. Downstream of the contact point 9, the thickness of the cleaning member 4 between the supporting member 10 and the charging roller 3 is smaller than the thickness B. In other words, the cleaning member 4 is pressed to deform, and slides on the surface of the charging roller 3 in intimate contact with the charging roller 3 under a stable pressing force.

The cleaning member 4 upstream of the contact point 9 extends a distance L (e.g., $L \geqq 1$ mm) from the contact point 9 and is away from the charging roller 3, so that when the surface of the charging roller 3 moves into contact with the cleaning member 4 at the contact point 9, the free end of the cleaning member 4 is not pulled in between the charging roller 3 and the cleaning member 4.

Figure 7:
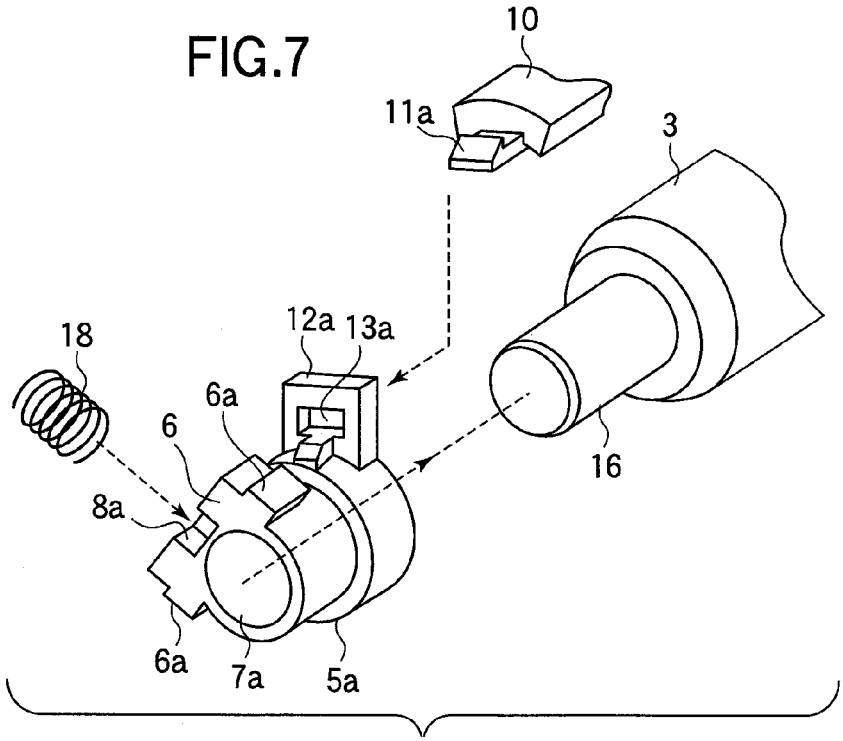
FIGS. 7 and 8 are enlarged views of the charging device.
Figure 8:
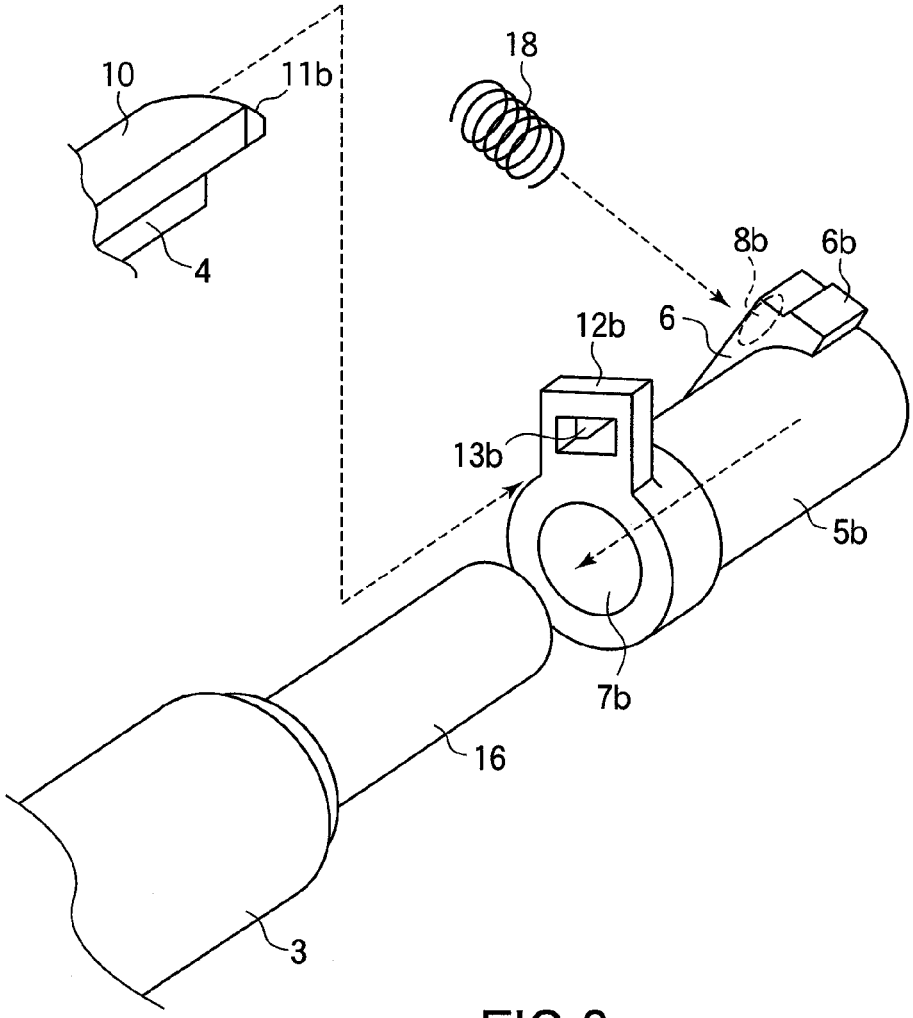

FIGS. 7 and 8 are enlarged views of the charging device 1. The charging device 1 includes the charging roller 3, cleaning member 4 that cleans the charging roller 3, supporting member 10 that supports the cleaning member 4, and bearings 5*a* and 5*b* that support the shaft 16 of the charging roller 3.

The shaft 16 of the charging roller 3 extends through the holes 7*a* and 7*b* of the bearings 5*a* and 5*b*, respectively, so that the shaft 16 is rotatably received by the bearings 5*a* and 5*b*. The bearings 5*a* and 5*b* include recesses 8*a* and 8*b*, respectively, which receive the springs 18 fittingly. The bearings 5*a* and 5*b* further include the coupling portions 12*a* and 12*b* formed thereon, angularly spaced apart from the recesses 8*a* and 8*b*. The rectangular holes 13*a* and 13*b*, formed in the coupling portions 12*a* and 12*b*, receive the hooks 11*a* and 11*b* of the supporting member 10, respectively, so that the bearings 5*a* and 5*b* and the supporting member 10 are assembled together in an in integral assembly.

Figure 9:
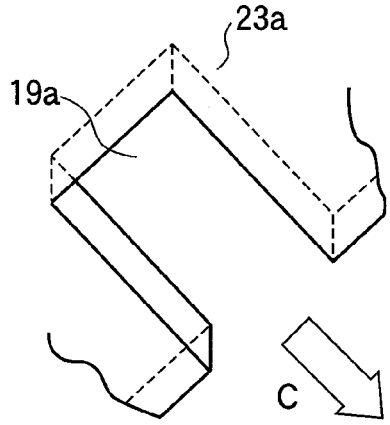
FIG. 9 is a perspective view of a bearing guide formed in a side cover of the image forming unit.

FIG. 9 is a perspective view of the bearing guide 19*a* formed in a side cover 23*a* of the image forming unit 52BK. The engagement portions 6*a* of the bearings 5*a* are received in the bearing guide 19*a*. The bearing 5*a* is received in the bearing guide 19*a*, and the spring 18 urge the bearing 5*a* in the C direction, so that the charging roller 3 is urged against the photoconductive drum 2 with a predetermined pressing force (FIG. 4).

Another bearing guide is formed in another side cover (not shown) of the image forming unit 52BK, being of the same construction as the bearing guide 19*a* and being disposed opposite to the bearing guide 19*a*.

As described above, the supporting member 10 that supports the cleaning member 4 is assembled to the bearings 5*a* and 5*b* in an integral assembly. This integral assembly maintains an accurate distance between the charging roller 3 and the surface of the supporting member 10 on which the cleaning member 4 is mounted, thereby reducing variations of the pressing force exerted by the cleaning member 4 on the charging roller 3. The first embodiment provides a charging device of simple construction which requires a minimum number of parts and a minimum assembly time, and that may be assembled with high assembly accuracy.

The first embodiment is advantageous in that the area of the cleaning member 4 in contact with the circumferential surface may be increased, and that the cleaning performance is improved without employing a reciprocating mechanism that causes the cleaning member to reciprocate relative to the charging roller 3 or without pressing the cleaning member 4 against the charging roller 3 under a large pressing force. Further, the end portion of the cleaning member extends away from the charging roller 3 so that the free end of the cleaning member 4 is not pulled in between the charging roller 3 and the cleaning member 4 during the rotation of the charging roller 3.

Second Embodiment

Elements similar to those of the first embodiment have been given the same reference numerals and their description is omitted.

Figure 10:
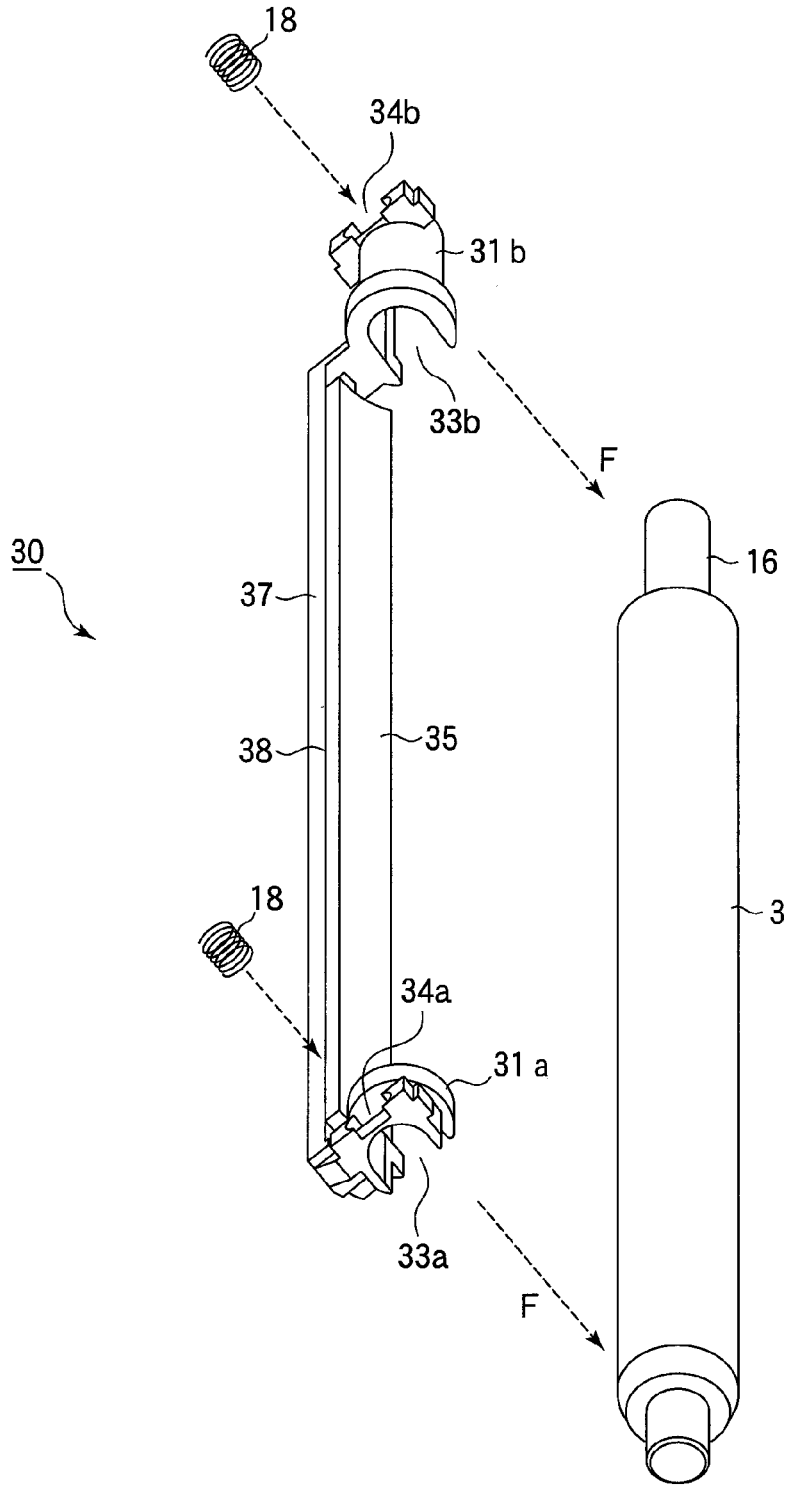
FIG. 10 is an exploded perspective view of a charging device of a second embodiment.

FIG. 10 is an exploded perspective view of a charging device 30. Referring to FIG. 10, a cleaning member 35 is formed of an open-cell sponge material. A supporting member 37 extends in a longitudinal direction. Bearings 31*a* and 31*b* are formed at longitudinal end portions of the supporting member 37 in one piece construction with the supporting member 37. The bearings 31*a* and 31*b* receive longitudinal end portions of a shaft 16 of a charging roller 3. A cleaning member 35 extends in a longitudinal direction parallel to the charging roller 3, and is bonded by an adhesive such as a double stick tape to the supporting member 37 such that the cleaning member 37 is sandwiched between the supporting member 37 and the charging roller 3 when the charging device 30 has been assembled to the photoconductive drum 2.

The generally U-shaped bearings 31*a* and 31*b* include spring receiving recesses 34*a* and 34*b* (FIG. 14) and openings 33*a* and 33*b*, respectively. The spring receiving recess 34*a* is formed on a side of the bearing 31*a* opposite to the opening 33*a* of the U-shape. The shaft 16 of the charging roller 3 is fittingly received in the openings 33*a* and 33*b* of the bearings 31*a* and 31*b*, respectively.

Figure 11:
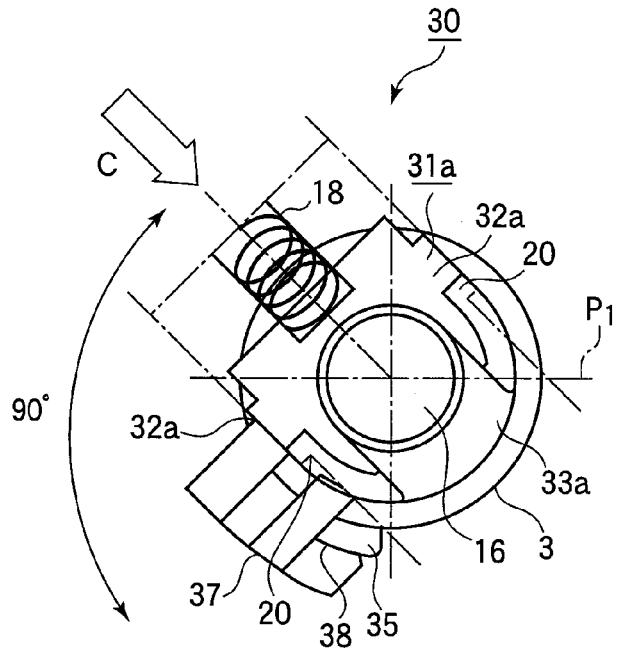
FIG. 11 is a side view of the charging device of FIG. 10.

FIG. 11 is a side view of the charging device 30. As described above, the openings 33*a* (33*b*) fittingly receive the shaft 16, and the spring 18 urges the bearings 31*a* (31*b*) in a direction shown by arrow C against the shaft 16 such that the charging roller 3 is pressed against the photoconductive drum 2. In this manner, the charging roller 3 is in pressure contact with the photoconductive drum 2 under a predetermined pressing force.

The bearing 31*a* includes projections 32*a* and 32*a*. The projections 32*a* and 32*a* slide on the side walls of a bearing guide 19*a* shown in FIG. 9, allowing the bearing 31*a* to move in the C direction until the charging roller 3 contacts the photoconductive drum 2.

The supporting member 37 is downstream of the spring 18 with respect to rotation of the charging roller 3, angularly spaced by an angle of 90 degrees from the spring 18. This structure allows the line of action of the spring force and the line of the friction force between the cleaning member 35 and the charging roller 35 to be parallel to each other, effectively allowing the line of action of the spring force to always pass through the rotational axis of the charging roller 3.

The supporting member 37 is positioned below a horizontal plane P1 in which the rotational axis of the charging roller 3 lies. In other words, the cleaning member 35 is below the rotational axis of the charging roller 3 in a gravitational direction. This implies that foreign matter scraped by the cleaning member 35 from the charging roller 3 falls through the open-cells of the open-cell sponge material due to gravity, so that no foreign matter builds up on the surface of the cleaning member 35. This prolongs the life time of the cleaning member 35 over which good cleaning performance is obtained.

Figure 12:
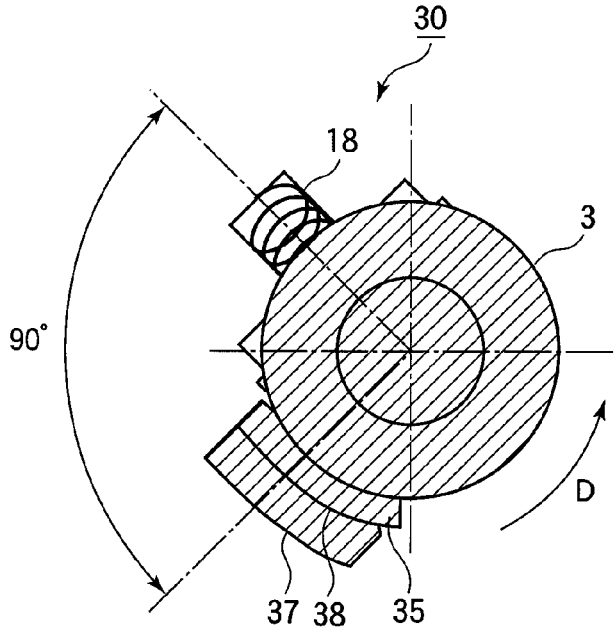
FIG. 12 is a cross-sectional view of the charging device.

FIG. 12 is a cross-sectional view of the charging device 30. Referring to FIG. 12, the cleaning member 35 is bonded to a surface 38 of the supporting member 37 by an adhesive such that the cleaning member 37 is sandwiched between the supporting member 37 and the charging roller 3 when the charging device has been assembled to the photoconductive drum 2. The cleaning member 35 is in pressure contact with the charging roller 3 under a predetermined pressure, and is slidable on the surface of the charging roller 3.

Figure 13:
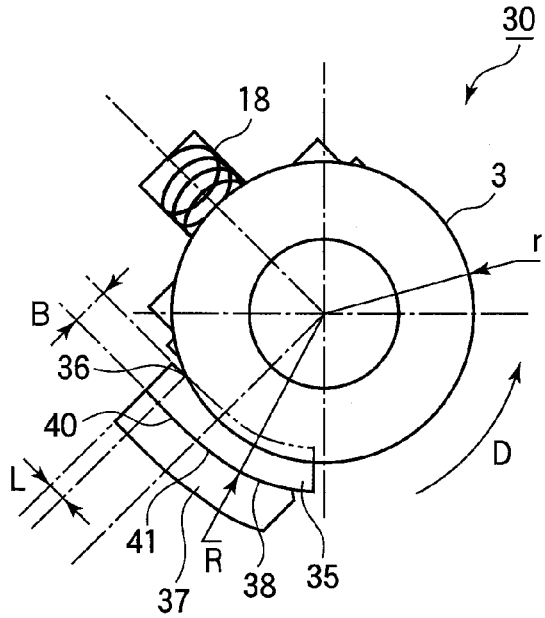
FIG. 13 illustrates a cleaning member of the second embodiment when the cleaning member has been mounted to the charging device.

FIG. 13 illustrates the cleaning member 35 when the cleaning member 35 has been mounted to the charging device 30. Referring to FIG. 13, the surface 38 of the supporting member 37 includes a flat surface 40 and a curved surface 41. The flat surface 40 extends upstream with respect to rotation of the charging roller 3 shown by arrow D, being parallel to a plane tangent to the charging roller 3. The curved surface 22 extends downstream of the flat surface 40 with respect to the D direction, having a radius R as well as being coaxial with the surface of the charging roller 30. The cleaning member 35 has a uniform thickness B before it is mounted to the charging roller 3. After the cleaning member 35 has been mounted to the charging roller 3, the thickness of the cleaning member 35 upstream of a contact point 36 remains B. The cleaning member 35 downstream of the contact point 36 is pressed to resiliently deform so that the cleaning member 35 slides on the surface of the charging roller 3 in intimate contact with the charging roller 3 under a stable pressing force.

When the charging roller 3 rotates in the D direction, there is a gap between the charging roller 3 and the cleaning member 35 upstream of the contact point 36. The cleaning member 35 at the contact point 36 contacts the charging roller 3 but does not receive a significant pressure from the charging roller 3. There is a distance B at the contact point 36 between the supporting member 37 and the charging roller 3. There is a shorter distance (<B) between the charging roller 3 and the supporting member 37 downstream of the contact point 36 than at the contact point 36. Thus, the cleaning member 35 is compressed, rubbing the circumferential surface of the charging roller 3 with a stable pressing force while maintaining accurate mechanical relation with the charging roller 3.

The cleaning member 35 extends a distance L (e.g., L≧1 mm) from the contact point 36 to an upstream side and is away from the charging roller 3, so that when the surface of the charging roller 3 rotates into contact with the cleaning member 35 at the contact point 9, the free end of the cleaning member 35 is not pulled in between the charging roller 3 and the cleaning member 35.

Figure 14:
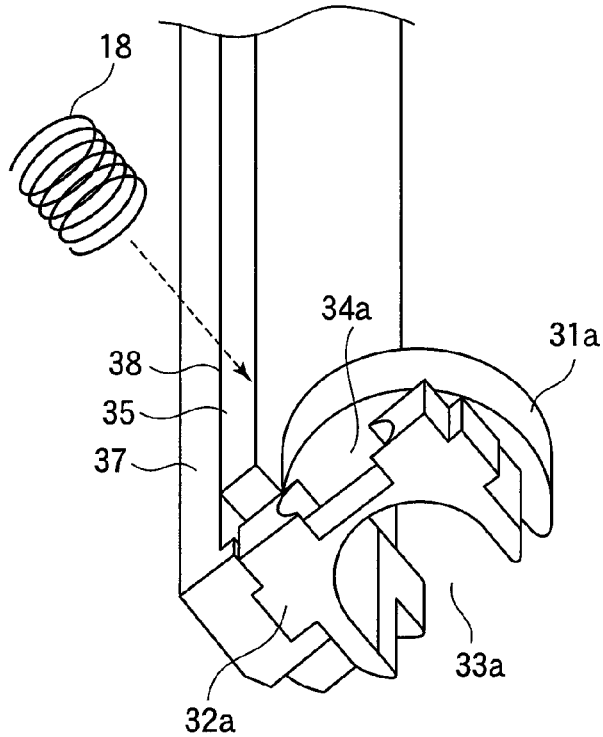
FIGS. 14 and 15 are expanded perspective views of the charging device.
Figure 15:
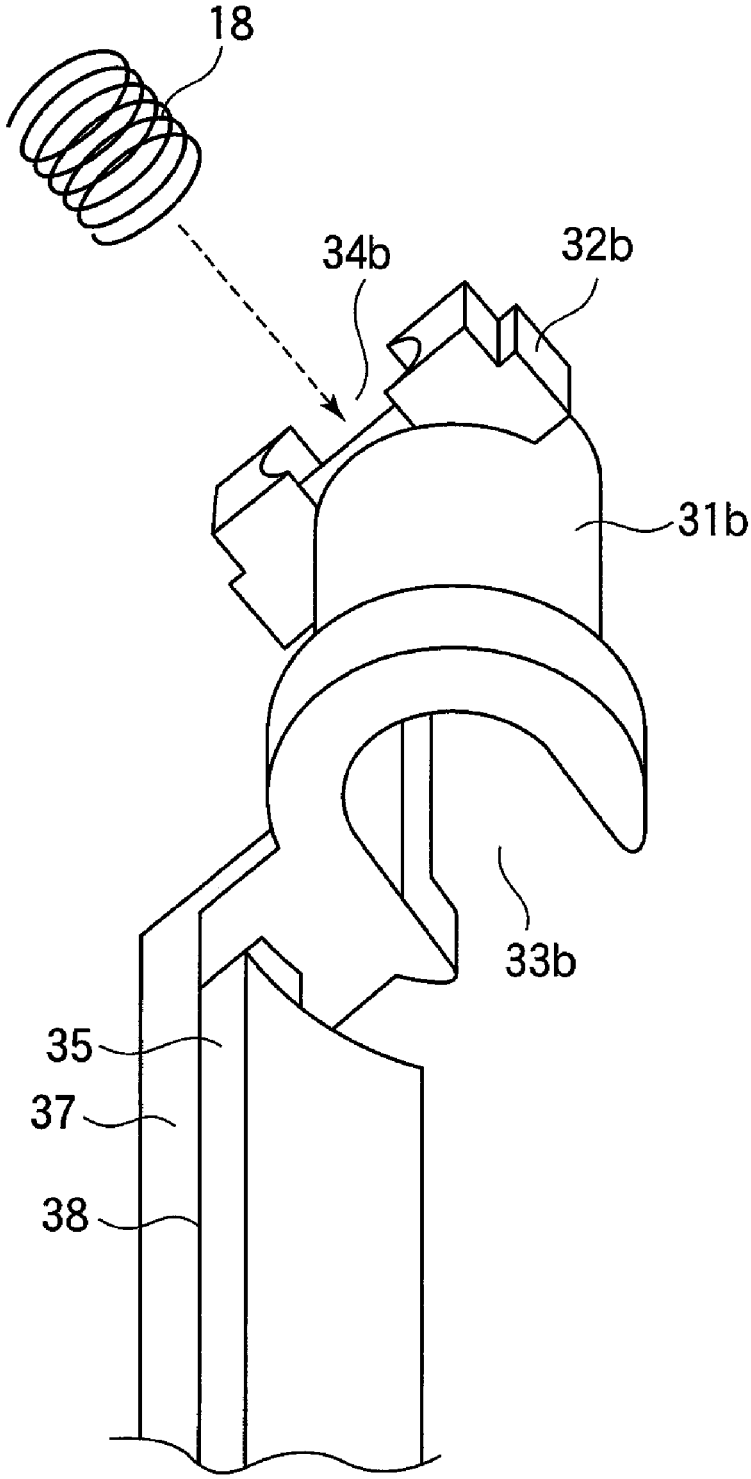

FIGS. 14 and 15 are expanded perspective views of the charging device 30. Referring to FIGS. 14 and 15, the supporting member 37 and bearings 31*a* and 31*b* that receive the longitudinal end portions of the shaft 16 of the charging roller 3 are assembled in an integral assembly. The cleaning member 35 is bonded to the surface 38 of the supporting member 37 by an adhesive such as a double stick tape.

The bearing 31*a* and 31*b* include recesses 34*a* and 34*b*, respectively. The recess is formed on a side of the bearing opposite to the opening of the U-shaped opening. The bearings 31*a* and 31*b* receive the longitudinal end portions of the shaft 16 of the charging roller 3.

As described above, the supporting member 37 is in one piece construction with the bearings 31*a* and 31*b*, thereby maintaining an accurate distance between the supporting member 37 and the charging roller 3. This reduces variations in the pressing force exerted by the cleaning member 35 on the charging roller 3. Therefore, the second embodiment provides a charging device of simple construction that requires a less number of parts and assembly time while maintaining assembly accuracy.

When the bearings are moved in the F direction (FIG. 10), the U-shaped openings 33*a* and 33*b* formed in the bearings 31*a* and 31*b*, respectively, fit easily over the shaft 16 of the charging roller 3.

The supporting member 37 is positioned below a horizontal plane in which the rotational axis of the charging roller 3 lies. Therefore, the cleaning member 35 is below the rotational axis of the charging roller 3 in the gravitational direction, foreign matter scraped by the cleaning member 35 go down due to gravity through the open-cell sponge material so that the foreign matter will not accumulated on the cleaning member 35, prolonging the cleaning performance.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A charging apparatus that includes a charging roller that charges a surface of an image bearing body, and a cleaning member that extends in a longitudinal direction substantially parallel to the charging roller and that cleans the charging roller, the charging apparatus comprising:

a bearing that supports a shaft of the charging roller; and a supporting member to which the cleaning member is mounted such that the cleaning member is held between the supporting member and the charging roller, the supporting member including a surface to which the cleaning member is mounted, the surface including a flat portion and a curved portion, the flat portion extending upstream of the curved portion with respect to rotation of the charging roller and a curved portion extending downstream with respect to rotation of the charging roller, wherein the flat portion extends in a plane substantially parallel to a plane tangent to a circumferential surface of the charging roller, and the curved portion extends in a plane substantially coaxial with the circumferential surface of the charging roller.

2. The charging apparatus according to claim 1, wherein the curved portion has a curved surface complementary to a circumferential surface of the charging roller.

3. The charging apparatus according to claim 1, wherein the cleaning member includes a flat portion having a free end that extends away from the charging roller.

4. The charging apparatus according to claim 1, further comprising at least one urging member that urges the charging roller against the image bearing body.

5. The charging apparatus according to claim 1, wherein the bearing is generally U-shaped.

6. The charging apparatus according to claim 5, wherein an urging member is positioned on a side of the bearing opposite to an opening of the U-shape, and the supporting member is downstream of a spring with respect to rotation of the charging roller, angularly spaced by an angle of 90 degrees from the spring.

7. The charging apparatus according to claim 6, wherein the cleaning member is below a horizontal plane in which a rotational axis of the charging roller lies.

8. The charging apparatus according to claim 1, wherein the cleaning member is formed of a sponge material.

9. An image forming unit that incorporates the charging apparatus according to claim 1.

10. An image forming apparatus that incorporates the image forming unit according to claim 9.

11. The charging apparatus according to claim 1, wherein the supporting member and the bearing are independent from each other and are assembled together in an integral assembly.

12. The charging apparatus according to claim 1, wherein the supporting member and the bearing are formed in one piece construction.

13. The charging apparatus according to claim 1, wherein the curved portion is contiguous to the flat portion.

* * * * *